US006206720B1

(12) United States Patent
Larkin et al.

(10) Patent No.: US 6,206,720 B1
(45) Date of Patent: Mar. 27, 2001

(54) CONNECTOR FOR ELECTRICAL CABLE

(75) Inventors: Brian S. Larkin, Moss Beach, CA (US); Victor V. Aromin, West Warwick, RI (US)

(73) Assignees: Tyco Electronics Corporation, Middletown, PA (US); Tower Manufacturing Corporation, Providence, RI (US)

( * ) Notice: Subject to any disclaimer, the term of this patent is extended or adjusted under 35 U.S.C. 154(b) by 0 days.

(21) Appl. No.: 09/479,354

(22) Filed: Jan. 7, 2000

Related U.S. Application Data

(63) Continuation of application No. 09/173,047, filed on Oct. 15, 1998, now abandoned.

(51) Int. Cl.[7] ..... H01R 4/24; H01R 4/26; H01R 11/20; H01R 13/648

(52) U.S. Cl. ..... 439/395; 439/404; 439/405

(58) Field of Search ..... 439/395, 404, 439/405, 400, 403, 396, 398

(56) References Cited

U.S. PATENT DOCUMENTS

| | | | |
|---|---|---|---|
| 3,858,144 | 12/1974 | Bedard et al. | 338/22 R |
| 3,861,029 | 1/1975 | Smith-Johannsen et al. | 29/611 |
| 4,017,715 | 4/1977 | Whitney et al. | 219/553 |
| 4,089,580 | 5/1978 | Huffnagle et al. . | |
| 4,169,646 | 10/1979 | Stape et al. . | |
| 4,242,573 | 12/1980 | Batliwalla | 219/528 |
| 4,334,148 | 6/1982 | Kampe | 219/553 |
| 4,334,351 | 6/1982 | Sopory | 29/611 |
| 4,426,339 | 1/1984 | Kamath et al. | 264/22 |
| 4,459,473 | 7/1984 | Kamath | 219/553 |
| 4,574,188 | 3/1986 | Midgley et al. | 219/549 |
| 5,002,501 | 3/1991 | Tucker | 439/417 |
| 5,004,432 * | 4/1991 | Tucker | 439/417 |
| 5,111,032 | 5/1992 | Batliwalla et al. | 219/549 |
| 5,252,081 | 10/1993 | Hart | 439/98 |
| 5,269,700 * | 12/1993 | Mitra | 439/395 |
| 5,492,485 * | 2/1996 | Drewantz et al. | 439/404 |
| 5,718,600 | 2/1998 | D'Amario, Jr. et al. | 439/410 |
| 5,756,972 | 5/1998 | Vranicar et al. | 219/541 |
| 5,759,061 | 6/1998 | Jensen et al. | 439/402 |

FOREIGN PATENT DOCUMENTS

| | | |
|---|---|---|
| 36 04 617 | 8/1987 | (DE) . |
| WO 91/17642 | 11/1991 | (WO) . |

* cited by examiner

*Primary Examiner*—Brian Sircus
*Assistant Examiner*—Chandrika Prasad

(57) ABSTRACT

An insulation displacement connector (IDC) suitable for making an electrical connection to an electrical cable having first and second elongate electrodes separated by a polymer. The IDC is in the form of a fork having first and second tines separated from one another by a slot and connected at a base. Extending from the closed end of the slot, along part of the base, is a beveled groove with a cutting edge. The IDC may be used in an assembly which contains an insulation displacement connector (IDC) module with first and second piercing members, each of which contains an IDC. The IDC module can be mated with a wire guide module, so that when the cable is inserted into the wire guide module and the wire guide module and IDC module are secured, the first piercing member contacts and makes electrical connection to the first elongate electrode and the second piercing member contacts and makes electrical connection to the second elongate electrode. The IDC module and wire guide module can also be used in an electrical plug which can be connected to a source of electrical power.

17 Claims, 3 Drawing Sheets

CONNECTOR FOR ELECTRICAL CABLE

This application is a continuation of prior Application Ser. No. 09/173,047, filed Oct. 15, 1998 now abandoned.

BACKGROUND OF THE INVENTION

1. Field of the Invention

This invention relates to an insulation displacement connector, and to an assembly or electrical plug which comprises the insulation displacement connector and is used for making an electrical connection to an electrical cable.

2. Introduction to the Invention

Elongate cables such as power cords, grounded power leads, or heating cables often must be electrically connected to another elongate cable or to a source of electrical power such as a wall outlet. An electrical plug is frequently used to make connection to a power source. Connection of the cable to the connector or the plug can require tedious and craft-sensitive assembly, as well as the use of special tools, in order to ensure that good electrical connection is achieved.

Elongate heating cables are one type of cable which often requires connection to a connector or a plug. Such heating cables are known for use in the freeze protection and temperature maintenance of pipes. Particularly useful elongate heating cables comprise (a) first and second elongate electrodes, (b) a plurality of resistive heating elements connected in parallel between said electrodes, e.g. a continuous strip of a conductive polymer in which the electrodes are embedded or which is wrapped around the electrodes, and (c) an insulating jacket, composed, for example of an insulating polymer, which surrounds the electrodes and heating elements. In addition, the heating cable often also comprises a metallic grounding layer, in the form of a braid or a tape, surrounding the insulating jacket, which serves to electrically ground the heating cable and provides abrasion resistance. The heating cable may be cut to the appropriate length for each application, and connection must then be made to the connector or plug.

Conventional connectors and electrical plugs for use with electrical cables such as heating cables often require that, prior to installation of the cable into the plug, the conductive polymer must be stripped from the electrodes. Such an electrical plug is disclosed in U.S. Pat. Nos. 5,002,501 (Tucker) and 5,004,432 (Tucker). Stripping the polymer can be difficult, may require special tools, and may not result in completely "clean" electrodes, thus making good electrical connection to the plug difficult. In addition, the time required to strip the polymer and assemble the plug can be relatively high. Other conventional plugs do not require that the cable be stripped prior to insertion into the plug. U.S. Pat. No. 5,252,081 (Hart) discloses a plug in which connection to the electrodes is made with conductive piercing means which penetrate the insulating jacket and the conductive polymer, thus contacting the electrodes. In order to make adequate contact, it is necessary that the piercing means, e.g. screws, be sufficiently tightened. In addition, it is important that the dimensional tolerance be precise to ensure that the screws directly contact the electrodes and maintain good electrical connection even after creep and/or aging of the polymer and electrodes. U.S. Pat. No. 5,718,600 (D'Amario et al) discloses another plug which does not require stripping of the polymer prior to insertion, but which uses a rotating cutting element located inside the plug housing to cut and remove polymer from the electrodes. Rotation of the cutting element also forces the electrodes into physical contact with electrical contacts. U.S. Pat. No. 5,756,972 (Vranicar et al) discloses a connector in which a cable is inserted into a housing and connection is made to a second cable. Insulation displacement connectors are used to make connection to the unstripped cables. The disclosure of each of these patents is incorporated herein by reference.

BRIEF SUMMARY OF THE INVENTION

Insulation displacement connectors are known for use in making electrical contact to the electrodes of electrical cables. An insulation displacement connector (IDC) can be of any configuration, but often has a fork shape, with two tines separated by a slot and connected at the base. Often the tines have sharp edges at their tips to penetrate the polymer surrounding the electrodes. However, one problem that can arise when an IDC of this type is used is that the polymer can build up at the base of the slot, interfering with making a dependable electrical connection. While some conventional IDCs have a relief cavity for extra material, they must be made from expensive alloys, e.g. beryllium-copper, which have sufficient elasticity to provide adequate spring force or hold strength. We have now found that it is possible to make an easy, reliable connection to an electrical cable, especially an electrical cable comprising stranded electrodes, by using an IDC which comprises a beveled groove at the bottom of the slot between the tines. The beveled groove provides a notch in the polymer surrounding the electrodes, which separates the polymer and leaves a clean surface for good electrical connection. There is no need for a relief cavity and thus less expensive materials, e.g. brass, can be used, while still achieving good contact. Such IDCs are useful in an assembly for making connection, as well as in a connector or an electrical plug. Thus, in a first aspect this invention provides an insulation displacement connector in the form of a fork which comprises (1) a first tine comprising (a) a first beveled tip, and (b) a first section having a first length and a first width, (2) a second tine comprising (a) a second beveled tip, and (b) a second section having a second length and a second width, (3) a base connecting the first and second tines, (4) a slot which (a) separates the first and second tines, and (b) has an open end between the first and second tips and a closed end at the base; and (5) a beveled groove (a) comprising a cutting edge, and (b) extending from the closed end away from the first and second tips and along part of the base.

It is often useful to mount IDCs onto a fixture to make electrical connection easier. Thus, in a second aspect, the invention provides an assembly for making an electrical connection to an electrical cable which comprises a first elongate electrode and a second elongate electrode, said first and second electrodes surrounded by and separated from one another by a polymer, said assembly comprising (A) an insulation displacement connector (IDC) module which comprises first and second piercing members, each of which comprises an insulation displacement connector according to the first aspect of the invention; and (B) a wire guide module which (1) contains a channel sized to contain the cable, and (2) is capable of mating with the IDC module in a unique mated configuration so that when the cable is inserted into the channel and the IDC module and the wire guide module are mated, the first piercing member pierces the cable and makes electrical contact to the first electrode, and the second piercing member pierces the cable and makes electrical contact to the second electrode.

In a third aspect, this invention provides an electrical plug for connecting an electrical cable to an electrical power outlet, said electrical cable comprising a first elongate electrode and a second elongate electrode, said first and second electrodes surrounded by and separated from one another by a polymer, said plug comprising (A) a housing which comprises
  (1) a first housing member, and
  (2) a second housing member, the first and second housing members being movable relative to each other between a demated configuration and a unique mated configuration which provides an opening for receiving the cable;

(B) an insulation displacement connector (IDC) module which comprises first and second piercing members, each of which comprises an insulation displacement connector according to the first aspect of the invention; and (C) a wire guide module which
  (1) fits within the first housing member,
  (2) contains a channel sized to contain the cable, said channel aligned with the opening formed when the first and second housing members are mated, and
  (3) is capable of mating with the IDC module in a unique mated configuration so that when the cable is inserted into the channel and the IDC module and the wire guide module are mated, the first piercing member pierces the cable and makes electrical contact to the first electrode, and the second piercing member pierces the cable and makes electrical contact to the second electrode, and the first piercing member being electrically connectable to a first prong suitable for insertion into one socket of an electrical power outlet and the second piercing member being electrically connectable to a second prong suitable for insertion into a second socket of an electrical power outlet.

BRIEF DESCRIPTION OF THE DRAWINGS

The invention is illustrated by the drawings in which.

DETAILED DESCRIPTION OF THE INVENTION

Figure 1:
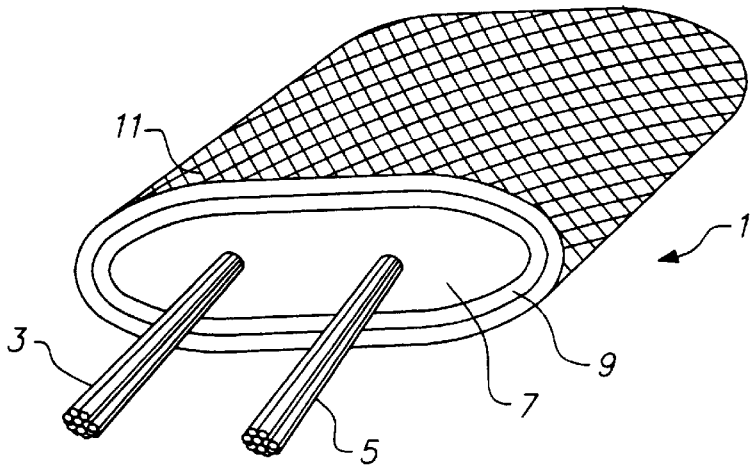
FIG. 1 is a perpective view of an electrical cable for use with the assembly or electrical plug of the invention.

The IDC and the assembly of the invention are designed to make an electrical connection to an elongate electrical cable. When the assembly is part of an electrical plug, connection can be made to an electrical power source, e.g. a wall outlet. The electrical cable may comprise a heating cable, a power cable or cord, a grounded power lead, or other type of cable. The cable comprises at least one, and preferably two, elongate electrodes, i.e. first and second elongate electrodes, which are surrounded by and separated from one another by a polymer. The polymer is preferably crystalline, i.e. has a crystallinity of at least 10% and preferably higher, as crystalline polymers tend to be more notch sensitive than amorphous polymers and this notch-sensitivity is useful when connection is made to the electrodes. The electrodes are preferably stranded wires, which, when inserted into the IDC slot, are less subject to damage due to the pressure of the IDC tines on the wire, than solid wires.

Elongate electrical cables particularly appropriate for use with this invention are electric heating cables which comprise first and second elongate electrodes, a plurality of resistive heating elements comprising a polymer connected in parallel between the electrodes, and at least one insulating jacket surrounding the electrodes and heating elements. The insulating jacket is generally polymeric, in the form of a continuous polymer layer, although a polymeric braid or a polymer tape may be used. For some applications a polymeric insulating jacket is surrounded by a second layer, e.g. a second polymeric insulating layer such as a polyester tape, or a metallized tape such as aluminized polyester. The heating cable often comprises an optional metallic grounding braid surrounding the insulating jacket and the optional second layer. The metallic grounding braid serves to electrically ground the heating cable and also provides mechanical strength and abrasion resistance. When a metallic grounding braid is present, it generally is in the form of braided metal wires, although for applications in which flexibility is not critical, it is possible to use another type of metal layer, e.g. a sheath or metal tape. In this specification, the term "metallic grounding braid" is intended to include non-braided metal layers. In some applications, the grounding braid itself is surrounded by an insulating jacket to provide environmental and electrical insulation to the heating cable. Particularly suitable heating cables are self-regulating strip heaters in which the electrodes are elongate stranded wires and the heating elements comprise a conductive polymer composition which exhibits PTC (positive temperature coefficient of resistance) behavior. The conductive polymer composition generally comprises a highly crystalline polymer, e.g. at least 40% crystalline, in which a particulate conductive filler is dispersed. Heaters of this type are described in U.S. Pat. Nos. 3,858,144 (Bedard et al), 3,861,029 (Smith-Johannsen et al), 4,017,715 (Whitney et al), 4,242,573 (Batliwalla), 4,334,148 (Kampe), 4,334,351 (Sopory), 4,426,339 (Kamath et al), 4,459,473 (Kamath), 4,574,188 (Midgley et al), and 5,111,032 (Batliwalla et al), and International Patent Publication No. WO91/17642 (Raychem Corporation, published Nov. 14, 1991). The disclosure of each of these patents and publications is incorporated herein by reference. The heating cable generally has an approximately rectangular cross-section with two generally parallel faces, although other geometries, e.g. round, oval, or elliptical, can also be used.

The IDC of the invention is in the form of a fork comprising first and second tines. The first tine comprises a first beveled tip and, connected to the first beveled tip, a first section having a first length and a first width. The second tine comprises a second beveled tip and, connected to the second beveled tip, a second section having a second length and a second width. The total length of the first tine, including the first section and the first beveled tip, is preferably the same as the total length of the second tine, including the second section and the second beveled tip. The first and second tines preferably have different widths, with the second width preferably at least 1.2 times, particularly at least 1.3 times, especially at least 1.5 times, the first width. The different widths allow the IDC to be used with cables having a small distance between the electrodes, i.e. a narrow center-to-center distance. The degree of beveling of the first and second tips is selected based on the type of polymer which is to be removed from the cable, but should be sufficient to easily pierce the polymer surrounding the electrodes (and any polymeric insulating jackets, if present). The first and second tines are connected by a base and are separated by a slot which has an open end between the first and second tips and a closed end at the base. For optimum effectiveness in making an electrical connection, the width of the slot is preferably 0.3 to 0.9 times the diameter of the electrode, particularly 0.4 to 0.8 times the diameter of the electrode, especially 0.5 to 0.8 times the diameter of the electrode, although the width of the slot is dependent on the type, configuration, and composition of the wire. For example, for an equilay concentric wire, a slot width of about 0.66 times the diameter has been found useful for a 22 AWG stranded electrode.

Extending from the closed end, away from the first and second tips and along part of the base, is a beveled groove. This groove, which has a cutting edge which is equivalent to the closed end of the slot, serves to provide a notch in the polymer between the first and second elongate electrodes which separates the polymer, leaving a clean groove for a good electrical connection. There is preferably a beveled groove extending from the closed end of the slot on both sides of the base, and preferably the taper of the beveled groove is such that it is deepest at the cutting edge and becomes narrow as the groove extends down the base. In a preferred embodiment, the taper does not leave a sharp edge on the base, i.e. at the end of the groove, so that the electrode is not damaged once contact to the IDC is made. At its maximum depth, i.e. at the cutting edge, the beveled groove is generally at most 60%, preferably at most 50%, particularly at most 40% of the thickness of the base of the IDC, so that sufficient strength can be retained at the cutting edge. When there are beveled grooves on both sides of the base, it is preferred that the depth of the grooves be the same on both sides, although for some applications, they can be different depths, lengths, or tapers. The width of the beveled groove may be the same as that of the slot or it may be different.

The IDC is preferably made of brass or brass alloys of the type used for connecting materials. Other types of materials can be used where greater elasticity is required or if the IDC is to be used under high temperature conditions.

The assembly of the invention comprises an insulation displacement connector (IDC) module which is capable of mating with a wire guide module in a unique mated configuration. The IDC module comprises first and second piercing members, each of which comprises an insulation displacement connector of the invention. The first and second piercing members are positioned on the IDC module asymmetrically, i.e. staggered, so that the first piercing member is positioned in front of the second piercing member and they are not physically in contact with one another. In addition, the first and second tines are alternated in position, i.e. the second tine of the first piercing member is positioned so that it is adjacent one outer edge of the cable, while the second tine of the second piercing member is positioned so that it is adjacent the opposite outer edge of the cable. The combination of the asymmetric positioning and the alternating of the different width tines allows connection to cables having very narrow center-to-center distances without compromising the dielectric distance between the tines of the adjacent electrodes. The piercing members may be attached to the IDC module by any suitable means, e.g. a compression fit or adhesive.

The wire guide module contains a channel sized to contain the cable. The channel preferably has a cross-section which is the same as that of the cable, so that the cable can be inserted into the channel and held securely in place. In a preferred embodiment, the channel comprises first and second openings through which the first and second piercing members can contact the first and second electrodes, respectively. The wire guide module may be made from a transparent material so that during installation, it is possible to observe the position of the cable. The wire guide module can be mated with the IDC module in a unique configuration and one or more guide posts can be part of the wire guide module to ensure proper positioning. Securing means such as screws or rivets can be used to hold the IDC and wire guide modules in their mated configuration. In addition, the securing means can be used to apply pressure as the two modules are joined, thus forcing the piercing members to penetrate and contact the electrodes. When the securing means are screws, this can be easily accomplished by tightening the screws in an alternating fashion until the piercing members penetrate the total thickness of the cable.

While the assembly can be used by itself, it is commonly used as part of an electrical plug. The plug comprises a housing which comprises first and second housing members which are capable of existing in a demated or a unique mated configuration. In the demated configuration, the housing members may be separate pieces or they may be connected, e.g. by hinges. When mated, the housing members are in contact with each other, either directly or indirectly through a sealing member such as a gasket. The housing members are maintained in their mated configuration by means of a securing means, e.g. a strap, a latch, a spring clamp, a bracket, one or more screws, or integral snaps. The securing means may be removable in order to allow the housing members to be demated from one another and allow the plug to be reenterable. In a preferred embodiment, the securing means comprises screws which, when tightened after insertion of the cable, ensure that good electrical contact is achieved and maintained.

The first housing member is generally a single piece which may be compartmentalized, either by ribs or bosses, or nominally, for various functions. At one end of the first housing member is a recess, which, when the first and second housing members are mated, forms an opening for receiving the cable. The first housing member should be large enough to accommodate the IDC module, which may be fixed to the first housing member, as well as optional elements such as strain relief means, a circuit interrupting device, signal indicator, fuse, or other element. These optional elements may be present in a second compartment in the first housing member, separated from the IDC module.

The second housing member may be a single piece which may be compartmentalized, but it often comprises two or more sections which are separated from one another. In a preferred embodiment, the second housing member comprises a first section containing the electrical components (e.g. circuit interrupting device, signal indicator, fuse), and a second section which will cover the wire guide module when it is mated to the IDC module. The first section often is secured in a permanent fashion to the first housing member before installation of the cable, while the second section can be readily removed and replaced.

First and second prongs for connection into a power outlet may be located directly on the housing of the plug, or, as is preferred, an electrical lead connected to the prongs may extend from the housing of the plug.

The plug may comprise additional electrical components for added functionality and safety. In a preferred embodiment, a fuse is electrically connected to the first prong and the second prong. Suitable fuses for use with plugs designed for 120 volt applications include those which have a 7 ampere/125 volt rating, such as those sold under the name Picofuse™ 7A/125V by Littelfuse Inc. or those sold under the name Microtron™ fuse MCR-7 by Bussman Division of Cooper Industries. It is also preferred that the first and second piercing members be electrically connected to a circuit interrupting device, which may be an equipment ground fault protective device (EGFPD). For example, a 27 mA-rated EGFPD can be used to provide ground fault protection of equipment. In addition, a signal indicator, e.g. a light, may be electrically connected, e.g. to the fuse or to another component, for various purposes, e.g. to indicate if power is applied to plug or if the fuse has tripped.

Cables used with the assembly and plug of the invention often comprises a metallic grounding braid, and in a preferred embodiment, the plug comprises a third prong suitable for insertion into the ground socket of an electrical power outlet, and a ground-contact section into which a grounding element, e.g. the braid, can be placed. The ground-contact section may be positioned in the first housing member adjacent the recess, and comprises a metallic clip or other attachment means which is electrically connected to the third prong by means of a wire, solder or metal trace, or other means. In use, the metallic grounding braid is folded back from the end of the cable, and twisted to form a tail. The cable is then inserted into the plug to position it within a cavity in the first housing member, adjacent the IDC module. The tail is inserted into or otherwise attached to the clip, making physical and electrical connection.

For many embodiments of the plug, also present is a means for strain relief. When making a connection of the cable into the plug, it is important that the cable be held in position with sufficient strength so that it cannot readily be pulled out of the plug. Generally a "pullout force" of at least 25 pounds (11.4 kg), preferably at least 30 pounds (13.6 kg), particularly at least 35 pounds (15.9 kg) is required for routine use. The pullout force can be measured according to a test in which a known weight, e.g. 35 pounds (15.9 kg), is hung on the end of the cable (following insertion into the plug) at an angle of 180° for one minute. The weight is then removed and the cable measured to determine if any slippage from the plug, or cutting or tearing of the cable, has occurred. If no damage or slippage is observed, the pullout force is said to be at least as great as the known weight. The strain relief means allows adequate pullout force to be generated when the cable is installed in the plug. In a preferred embodiment the strain relief means comprises a first strain relief element in the form of a rib and a second strain relief element in the form of an opposing rib. When the second housing member is mated with the first housing member and secured by the securing means, the cable is forced into a serpentine configuration between the opposing ribs. In a preferred embodiment, the strain relief means and the ground-contact section in the form of a clip may be combined in one unit.

The housing members, the wire guide module, the IDC module, and other structural elements of the assembly or plug may comprise an insulated metal or ceramic but preferably comprise a polymer which has an impact strength of at least 5 foot-pounds when shaped into the particular element and measured by such tests as UL 746C. Preferred polymers are of light weight, can be shaped by injection- or transfer-molding or similar processing techniques, and will withstand required intermittent use and continuous use temperatures. Appropriate polymers include polycarbonate, nylon, polyester, polyphenylene sulfide, polyphenylene oxide, and other engineering plastics. Appropriate fillers and stabilizers may be present. To improve the impact strength of the assembly or plug, internal elements such as ribs and bosses and external elements such as grooves may be incorporated into the design of the various elements.

The invention is illustrated in the following drawings in which FIG. 1 is a perpective view of electrical cable 1, which is a heating cable, in which first elongate electrode 3 and second elongate electrode 5 are embedded in conductive polymer matrix 7 which provides a resistive heating element. Insulating layer 9, which may comprise more than one layer, surrounds the conductive polymer matrix, and metallic grounding layer 11 surrounds the insulating layer.

Figure 2:
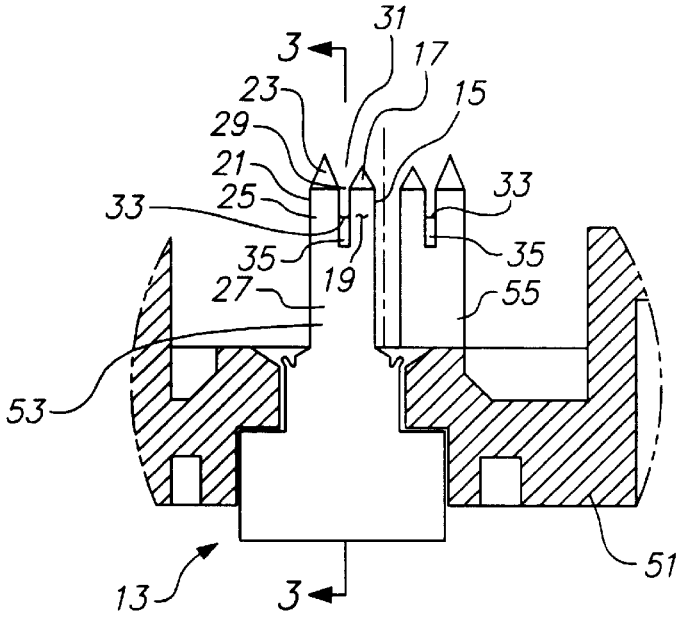
FIG. 2 is a plan view of an insulation displacement connector of the invention.
Figure 3:
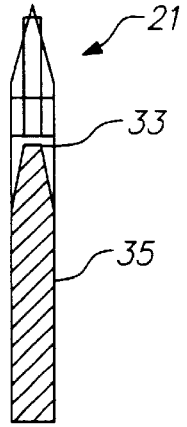
FIG. 3 is a cross-section along line 3—3 of FIG. 2.

FIG. 2 is a plan view of an IDC of the invention, with FIG. 3 a cross-section alongline 3—3. IDC 13 is in the form of a fork, with first tine 15 composed of first beveled tip 17 and first section 19 and second tine 21 composed of second beveled tip 23 and second section 25. First and second tines 15,21 are connected by base 27, but are separated by slot 29 which has open end 31 and closed end 33 which is the cutting edge of beveled groove 35.

Figure 4:
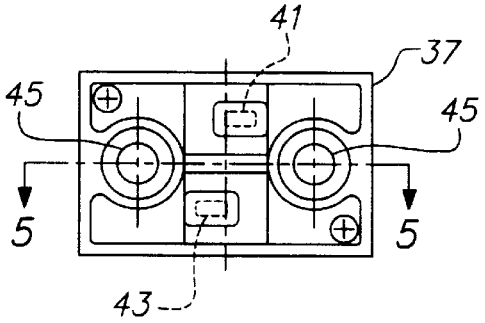
FIG. 4 is a top view of the wire guide module of the invention.
Figure 5:
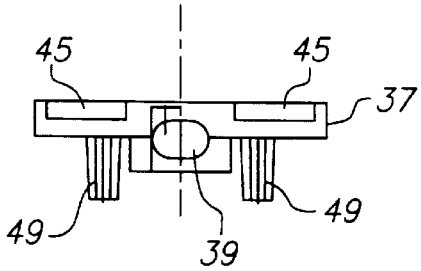
FIG. 5 is a cross-section along line 5—5 of FIG. 4.

FIG. 4 is a top view of a wire guide module, with FIG. 5 a cross-section along line 5—5. Wire guide module 37 contains channel 39. First opening 41 and second opening 43 in channel 39 allow contact between first piercing member 53 and first electrode 3, and second piercing member 55 and second electrode 5, respectively. Holes 45 for securing means 47 are positioned adjacent channel 39, and guide posts 49 are positioned at the corners of wire guide module 37.

Figure 6:
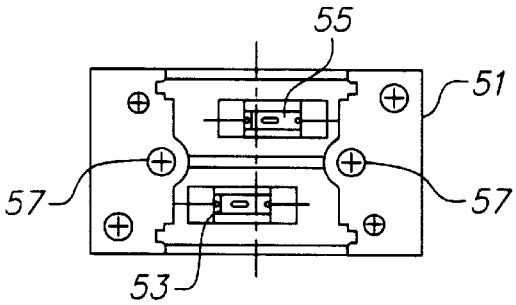
FIG. 6 is a top view of the IDC module of the invention.

FIG. 6 is a top view of the IDC module 51 of the invention. First and second piercing members 53,55 are shown in their asymmetrical, off-set position. Cavities 57 for securing means 47 are present.

Figure 7:
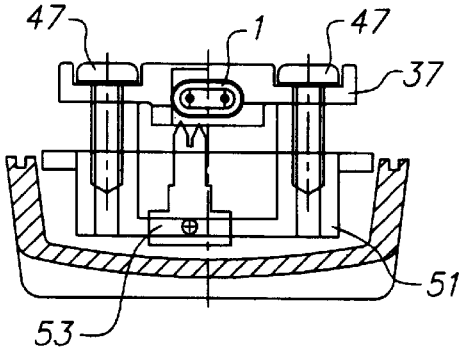
FIGS. 7 and 8 show in schematic cross-sectional view the wire guide module and DC module of the assembly of the invention before and after, respectively, connection is made to an electrical cable.
Figure 8:
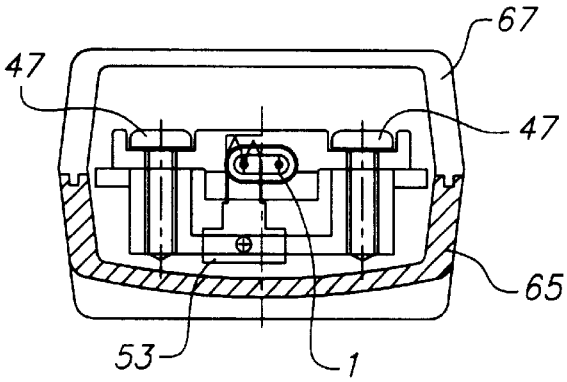

FIGS. 7 and 8 show in schematic cross-sectional view the wire guide module and IDC module of the assembly of the invention before and after, respectively, connection is made to an electrical cable. Securing means 47, shown here as screws, are gradually tightened, forcing first and second piercing members in contact with, and then through first and second electrode 3,5. Shown in FIG. 8 are first housing member 65 and first section of second housing member 67, which are part of the electrical plug of the invention.

Figure 9:
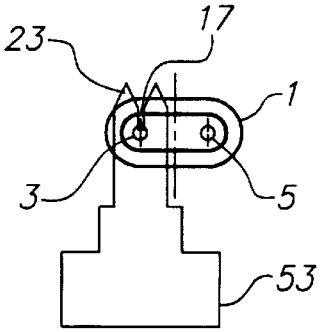
FIG. 9 shows a schematic view of a connection to one electrode of an electrical cable.
Figure 10:
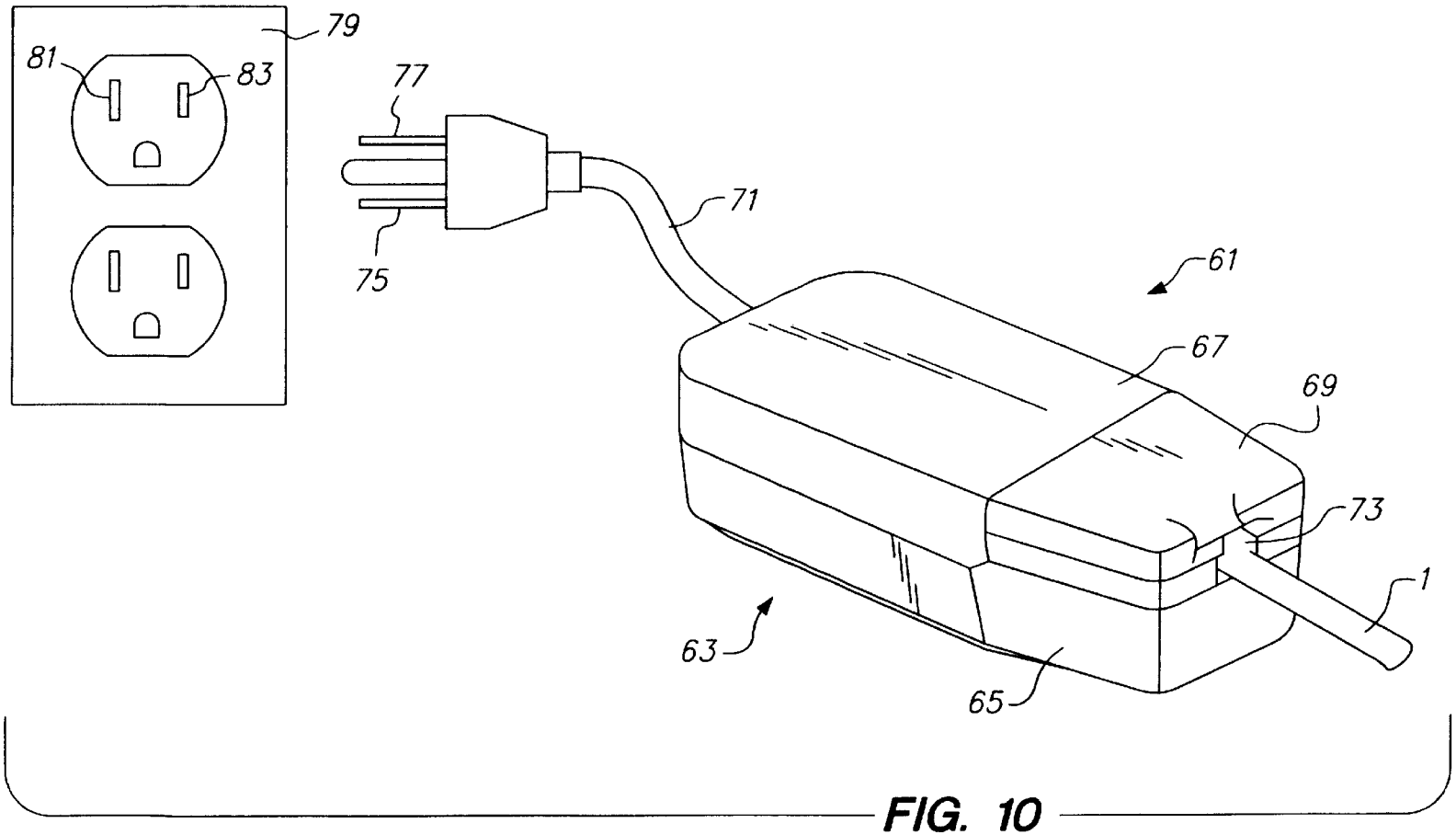
FIG. 10 shows a perspective schematic drawing of an electrical plug of the invention.

FIG. 9 shows a schematic view of a connection to first electrode 3 of electrical cable FIG. 10 shows a perspective schematic drawing of electrical plug 61. Housing 63 is composed of first housing member 65 and first and second parts 67,69 of second housing member. Lead 71 is attached to first and second prongs or electrical power for insertion into a wall or electrical power outlet 79. Power outlet 79 includes a first socket 81 and second socket 83 for receiving first and second prong 75, 77, respective. Opening 73, which is created when the first and second housing members are mated, allows cable 1 to be inserted.

The invention is illustrated by the following examples, in which Example 1 is a comparative example.

EXAMPLES 1

A Frostex Plus™ heating cable, manufactured by Raychem Corporation, was inserted into a channel of a wire guide module of the type shown in FIGS. 4 and 5. The cable had two 22 AWG equilay concentric nickel-coated copper wires, each with a nominal diameter of 0.81 mm (0.032 inch). The two wires were separated by and surrounded by a conductive polymer matrix. The conductive polymer matrix was surrounded by a first insulating polymer jacket, a second insulating polymer jacket in the form of a thin polyester film, and a metallic grounding braid. Prior to insertion, the grounding braid was pushed back from the second insulating jacket.

An IDC module, as shown in FIG. 6, was mated to the wire guide module. Attached in a staggered configuration to the IDC module were two IDCs, each in the form of a fork having two tines. The first tine had a width of about 0.81 mm (0.032 inch) and the second tine had a width of about 1.35 mm (0.053 inch), and the slot between them was about 0.51 mm (0.020 inch) long. There was no beveled groove extending from the base of the slot. The thickness of the base of the IDC, made from brass, was about 0.081 mm (0.032 inch). The screws were tightened so that the two IDCs pierced the heating cable and contacted the wires (see FIGS. 7 and 8). Only thirty percent of the samples tested had good electrical connection because the polymer bunched up in the region of the slot and prevented good contact between the IDCs and the wires.

EXAMPLE 2

The same procedure as in Example 1 was followed, except that the IDCs on the IDC module each had a beveled groove of approximately 0.51 mm (0.020 inch) width and 1.27 mm (0.050 inch) length extending from the base of the slot. The IDCs had beveled grooves on both sides of the base, with a thickness at the most narrow part, i.e. the cutting edge, of 0.51 mm (0.020 inch), so that about 30% of the total thickness of the base had been removed in the groove, about 15% on each side. One hundred percent of the samples tested with these IDCs of the invention had good electrical connection.

Although the invention has been described in detail for specific embodiments, it is to be understood that this is for clarity and convenience, and that the disclosure herein includes all the appropriate combinations of information found throughout the specification. It is to be understood that where a specific feature is disclosed in the context of a particular embodiment or figure, such feature can also be used, to the extent appropriate, in the context of another figure, in combination with another feature, or in the invention in general.

What is claimed is:

1. An insulation displacement connector in the form of a fork which comprises (1) a first tine comprising (a) a first beveled tip, and (b) a first section having a first length and a first width, (2) a second tine comprising (a) a second beveled tip, and (b) a second section having a second length and a second width, (3) a base connecting the first and second tines, (4) a slot which (a) separates the first and second tines, and (b) has an open end between the first and second tips and a closed end at the base; and (5) a beveled groove (a) comprising a cutting edge, and (b) extending from the closed end away from the first and second tips and along part of the base.

2. An insulation displacement connector according to claim 1 wherein the second width is at least 1.2 times the first width.

3. An insulation displacement connector according to claim 2 wherein the second width is at least 1.5 times the first width.

4. An assembly for making an electrical connection to an electrical cable which comprises a first elongate electrode and a second elongate electrode, said first and second electrodes surrounded by and separated from one another by a polymer, said assembly comprising (A) an insulation displacement connector (IDC) module which comprises first and second piercing members, each of which comprises an insulation displacement connector in the form of a fork which comprises (1) a first tine comprising (a) a first beveled tip, and (b) a first section having a first length and a first width, (2) a second tine comprising (a) a second beveled tip, and (b) a second section having a second length and a second width, (3) a base connecting the first and second tines, (4) a slot which (a) separates the first and second tines, and (b) has an open end between the first and second tips and a closed end at the base; and (5) a beveled groove (a) comprising a cutting edge, and (b) extending from the closed end away from the first and second tips and along part of the base; and (B) a wire guide module which (1) contains a channel sized to contain the cable, and (2) is capable of mating with the IDC module in a unique mated configuration so that when the cable is inserted into the channel and the IDC module and the wire guide module are mated, the first piercing member pierces the cable and makes electrical contact to the first electrode, and the second piercing member pierces the cable and makes electrical contact to the second electrode.

5. An assembly according to claim 4 wherein the channel comprises (1) a first opening through which the first piercing member can contact the first electrode, and (2) a second opening through which the second piercing member can contact the second electrode.

6. An assembly according to claim 4 wherein the IDC module and the wire guide module are held in the mated configuration by securing means.

7. An assembly according to claim 6 wherein, when the IDC module and the wire guide module are mated with the cable inserted into the channel, and the securing means are completely fastened, the cable is pierced through its thickness by both the first and second piercing members.

8. An assembly according to claim 4 wherein the second width is at least 1.2 times the first width.

9. An assembly according to claim 4 wherein the first piercing member and the second piercing member are positioned asymmetrically in the IDC module so that, when the IDC module and the wire guide module are mated with the cable inserted into the channel, there is no physical contact between the first and second piercing members.

10. An assembly according to claim 4 wherein the cable is an elongate heating cable which comprises (A) first and second elongate wire electrodes, (B) a plurality of resistive heating elements connected in parallel between said electrodes, and (C) an insulating jacket which surrounds the electrodes and heating elements.

11. An assembly according to claim 10 wherein the first and second elongate wire electrodes are stranded wires.

12. An electrical plug for connecting an electrical cable to an electrical power outlet, said electrical cable comprising a first elongate electrode and a second elongate electrode, said first and second electrodes surrounded by and separated from one another by a polymer, said plug comprising (A) a housing which comprises (1) a first housing member, and (2) a second housing member, the first and second housing members being movable relative to each other between a demated configuration and a unique mated configuration which provides an opening for receiving the cable;

(B) an insulation displacement connector (IDC) module which comprises first and second piercing members, each of which comprises an insulation displacement connector in the form of a fork which comprises (1) a first tine comprising (a) a first beveled tip, and (b) a first section having a first length and a first width, (2) a second tine comprising (a) a second beveled tip, and (b) a second section having a second length and a second width, (3) a base connecting the first and second tines, (4) a slot which (a) separates the first and second tines, and (b) has an open end between the first and second tips and a closed end at the base; and (5) a beveled groove (a) comprising a cutting edge, and (b) extending from the closed end away from the first and second tips and along part of the base; and (C) a wire guide module which (1) fits within the first housing member, (2) contains a channel sized to contain the cable, said channel aligned with the opening formed when the first and second housing members are mated, and (3) is capable of mating with the IDC module in a unique mated configuration so that when the cable is inserted into the channel and the IDC module and the wire guide module are mated, the first piercing member pierces the cable and makes electrical contact to the first electrode, and the second piercing member pierces the cable and makes electrical contact to the second electrode, and the first piercing member being electrically connectable to a first prong suitable for insertion into one socket of an electrical power outlet and the second piercing member being electrically connectable to a second prong suitable for insertion into a second socket of an electrical power outlet.

13. A plug according to claim 12 wherein the second width is at least 1.2 times the first width.

14. A plug according to claim 12 which further comprises a lead which is connected to a first prong suitable for insertion into one socket of an electrical power outlet and a second prong suitable for insertion into a second socket of an electrical power outlet.

15. A plug according to claim 14 which further comprises a fuse electrically connected to the first prong and the second prong.

16. A plug according to claim 12 wherein the cable is an elongate heating cable which comprises (A) first and second elongate wire electrodes, (B) a plurality of resistive heating elements connected in parallel between said electrodes, and (C) an insulating jacket which surrounds the electrodes and heating elements.

17. A plug according to claim 16 wherein the cable further comprises a metallic grounding layer in the form of a braid or a tape.

* * * * *